US008796163B2

(12) United States Patent
Okada

(10) Patent No.: US 8,796,163 B2
(45) Date of Patent: Aug. 5, 2014

(54) MULTI LAYER FABRICS FOR STRUCTURAL APPLICATIONS HAVING WOVEN AND UNIDIRECTIONAL PORTIONS AND METHODS OF FABRICATING SAME

(76) Inventor: Ryo Okada, Toronto (CA)

( * ) Notice: Subject to any disclaimer, the term of this patent is extended or adjusted under 35 U.S.C. 154(b) by 767 days.

(21) Appl. No.: 12/546,751

(22) Filed: Aug. 25, 2009

(65) Prior Publication Data

US 2010/0056005 A1 Mar. 4, 2010

Related U.S. Application Data

(60) Provisional application No. 61/092,762, filed on Aug. 29, 2008.

(51) Int. Cl.

| | |
|---|---|
| ***B32B 5/08*** | (2006.01) |
| ***B32B 5/26*** | (2006.01) |
| ***D03D 13/00*** | (2006.01) |
| ***B32B 7/08*** | (2006.01) |

(52) U.S. Cl.
USPC ..... 442/269; 442/203; 442/239; 442/268; 428/223

(58) Field of Classification Search
USPC ..... 442/203, 239, 268, 269, 271, 229, 243; 428/223
See application file for complete search history.

(56) References Cited

U.S. PATENT DOCUMENTS

| | | | | |
|---|---|---|---|---|
| 3,649,428 | A | | 3/1972 | Hughes |
| 3,841,954 | A | | 10/1974 | Lawler |
| 4,173,670 | A | | 11/1979 | VanAuken |
| 4,187,618 | A | * | 2/1980 | Diehl ..... 442/206 |
| 4,368,234 | A | | 1/1983 | Palmer et al. |
| 4,748,996 | A | | 6/1988 | Combier |
| 4,759,975 | A | * | 7/1988 | Sutherland et al. ..... 442/203 |
| 4,786,541 | A | | 11/1988 | Nishimura et al. |
| 4,911,973 | A | | 3/1990 | Dunbar |
| 4,929,503 | A | * | 5/1990 | Shirasaki et al. ..... 442/200 |
| 4,995,429 | A | * | 2/1991 | Kositzke ..... 139/383 R |
| 5,021,283 | A | | 6/1991 | Takenaka et al. |
| 5,238,728 | A | | 8/1993 | Aucagne |
| 5,327,811 | A | | 7/1994 | Price et al. |
| 5,358,767 | A | | 10/1994 | Bompard et al. |
| 5,427,728 | A | * | 6/1995 | Beck et al. ..... 264/229 |
| 5,507,915 | A | * | 4/1996 | Durkin et al. ..... 162/117 |
| 5,591,933 | A | | 1/1997 | Li et al. |
| 5,800,749 | A | | 9/1998 | Lewit et al. |
| 6,355,584 | B1 | * | 3/2002 | Corrons ..... 442/367 |
| 6,660,362 | B1 | * | 12/2003 | Lindsay et al. ..... 442/59 |
| 7,101,818 | B2 | | 9/2006 | Price et al. |

* cited by examiner

*Primary Examiner* — Jeremy R Pierce

(74) *Attorney, Agent, or Firm* — Bereskin & Parr LLP

(57) ABSTRACT

A multi-layer fabric, having a first woven portion having warp yarns and weft yarns interwoven together to form a first woven layer, a unidirectional portion that includes a first unidirectional layer having first unidirectional yarns, the first unidirectional layer being adjacent the first woven layer, and at least one securing yarn interwoven with the first woven layer and the first unidirectional layer to secure the first unidirectional portion to the first woven portion. The fabric may have encapsulating yarns interwoven with the first unidirectional yarns to secure the first unidirectional yarns together to form the first unidirectional layer.

16 Claims, 6 Drawing Sheets

MULTI LAYER FABRICS FOR STRUCTURAL APPLICATIONS HAVING WOVEN AND UNIDIRECTIONAL PORTIONS AND METHODS OF FABRICATING SAME

RELATED APPLICATIONS

This application claims the benefit of U.S. Provisional Patent Application Ser. No. 61/092,762, filed on Aug. 29, 2008, the entire contents of which are hereby incorporated by reference.

TECHNICAL FIELD

The teaching disclosed herein relates to fabrics, and in particular to fabrics for use in composite materials for structural applications, and methods of making the same.

INTRODUCTION

Woven fabrics are fabrics in which two distinct sets of yarns are interwoven with each other to form the fabric. Typically, woven fabrics include warp yarns that run lengthwise of the fabric and weft yarns that run across the length of the fabric, and which are interwoven with and generally perpendicular to the warp yarns.

By contrast, unidirectional fabrics are fabrics in which the yarns form parallel layers, generally without the over and under crimp or interlacing of a woven structure. Without the interlacing structure, some mechanism must be provided to hold the unidirectional yarns together. Some known mechanisms include the use of resins, polymer films bonded to the individual yarns, and stitching.

Unidirectional fabrics or unidirectional tape generally provide excellent mechanical properties (e.g. tensile and compressive strength) in directions aligned with the longitudinal directions of the fibers. However, due to the unidirectional nature of the fibers, such unidirectional fabrics and tapes often have low impact and fracture resistance.

Woven fabrics, on the other hand, tend to have lower mechanical properties (e.g. tensile and compressive strength) due to the interlacing of the warp and weft yarns, but often provide better impact and fracture resistance.

As a result, unidirectional and woven fabrics are often combined in structural applications. In particular, unidirectional fabrics may used in the middle portion of a structure to provide desired mechanical properties, while woven fabrics may be used on the outer surfaces of the structure to provide protection for the unidirectional fabric.

Conventionally, this may be done by providing the woven fabrics and unidirectional tapes or fabrics separately and then combining them to produce a multi-layer structure. For example, various fabric layers may be laid up and then joined together by resin. However, there are a several disadvantages to this technique. Firstly, since the woven fabrics and unidirectional tapes or fabrics are manufactured separately, this tends to result in higher associated costs. Furthermore, there may be issues related to the compatibility of the added resin, particularly if different sources supply the woven fabrics and unidirectional tapes or fabrics. Finally, there tend to be increased labor costs associated with laying up the layers to produce the structure.

In other known composites, multiple layers of unidirectional and woven fabric may be stitched together after being manufactured as separate layers. However, there tends to be a number of drawbacks with stitching layers together to form fabrics. Since stitched fabrics are woven by needles that penetrate through the layers of yarn, gaps may be formed where the stitches are provided. Furthermore, the penetration of the needles may cause damage to the structural yarns. Both of these results are generally undesirable.

Accordingly, the inventor has identified a need for improved fabrics for use in structural applications that include at least some of the benefits of both unidirectional fabrics and woven fabrics.

SUMMARY

According to one aspect, there is provided a multi-layer fabric, comprising a first woven portion having warp yarns and weft yarns interwoven together to form a first woven layer; a unidirectional portion that includes a first unidirectional layer having first unidirectional yarns, the first unidirectional layer being adjacent the first woven layer; and at least one securing yarn interwoven with the first woven layer and the first unidirectional layer to secure the first unidirectional portion to the first woven portion.

The fabric may further comprise encapsulating yarns interwoven with the first unidirectional yarns to secure the first unidirectional yarns together to form the first unidirectional layer.

The unidirectional yarns may be aligned with the warp yarns, and at least one of the securing yarns is woven underneath a first warp yarn, over a second unidirectional yarn, underneath a third warp yarn, over a fourth unidirectional yarn, and underneath a fifth warp yarn.

The encapsulating yarns and securing yarns may be made from a low strength, low modulus yarn.

The warp yarns, weft yarns and unidirectional yarns may have a tenacity of at least about 15 grams per denier, and a tensile modulus of at least about 400 grams per denier.

The encapsulating yarns and the securing yarns may be of significantly smaller denier than the warp yarns, weft yarns and the unidirectional yarns and have significantly lower tenacities and tensile moduli.

The encapsulating yarns and securing yarns may have a tenacity of less than about 10 grams per denier, and a tensile modulus of less than about 40 grams per denier.

The denier of the encapsulating yarns and the securing yarns may be less than about 1000 denier.

The encapsulating yarns and the securing yarns may have a diameter that is between about 2.5% and about 14% of the diameter of the warp yarns, weft yarns and unidirectional yarns.

The unidirectional portion may include a second unidirectional layer having second unidirectional yarns, the second unidirectional yarns oriented at a first angle with respect to the first layer of unidirectional yarns.

The second layer of unidirectional yarns may be secured to at least one of the first layer of unidirectional yarns and the first woven layer using at least one second securing yarn.

The second unidirectional yarns may be secured together by second encapsulating yarns interwoven therebetween so as to form the second unidirectional layer.

The second securing yarns may be interwoven with the first encapsulating yarns to secure the second unidirectional layer to the first unidirectional layer The fabric may further comprise a second woven portion opposite the first woven portion on the other side of the first unidirectional portion.

At least three encapsulating yarns may be provided for each securing yarn.

Adjacent encapsulating yarns may have an alternating weave.

Each securing yarn may be provided between two encapsulating yarns and continues the alternating weave.

According to another aspect, there is provided a method of fabricating a multi-layer fabric, comprising providing warp yarns; interweaving weft yarns with the warp yarns so as to form a woven layer; providing unidirectional yarns in a unidirectional layer; and interweaving at least one securing yarn with the unidirectional yarns and the warp yarns to secure the woven layer to the unidirectional layer.

The method may further comprise interweaving at least one encapsulating yarns with the unidirectional yarns to secure the unidirectional yarns together to form the unidirectional layer.

According to yet another aspect, there is provided a structural member comprising at least one multi-layer fabric, each multi-layer fabric comprising a first woven portion having warp yarns and weft yarns interwoven together to form a first woven layer; a unidirectional portion that includes a first unidirectional layer having first unidirectional yarns, the first unidirectional layer being adjacent the first woven layer; and at least one securing yarn interwoven with the first woven layer and the first unidirectional layer to secure the first unidirectional portion to the first woven portion; and a film or resin for securing the at least one multi-layer fabric together.

BRIEF DESCRIPTION OF THE DRAWINGS

The drawings included herewith are for illustrating various examples of articles, methods, and apparatuses of the present specification and are not intended to limit the scope of what is taught in any way. In the drawings.

DETAILED DESCRIPTION

Generally illustrated in FIGS. 1 to 7 is a multi-layer fabric 10 according to one embodiment.

The fabric 10 has a first woven or crimped portion that includes warp yarns 12 and weft yarns 14 that are interwoven together in a first layer as will generally be understood. The warp yarns 12 and weft yarns 14 in the fabric 10 are generally crimped, as each yarn is bent around the other yarns at crossover points or nodes to provide an interlocking or interwoven structure.

Figure 1:
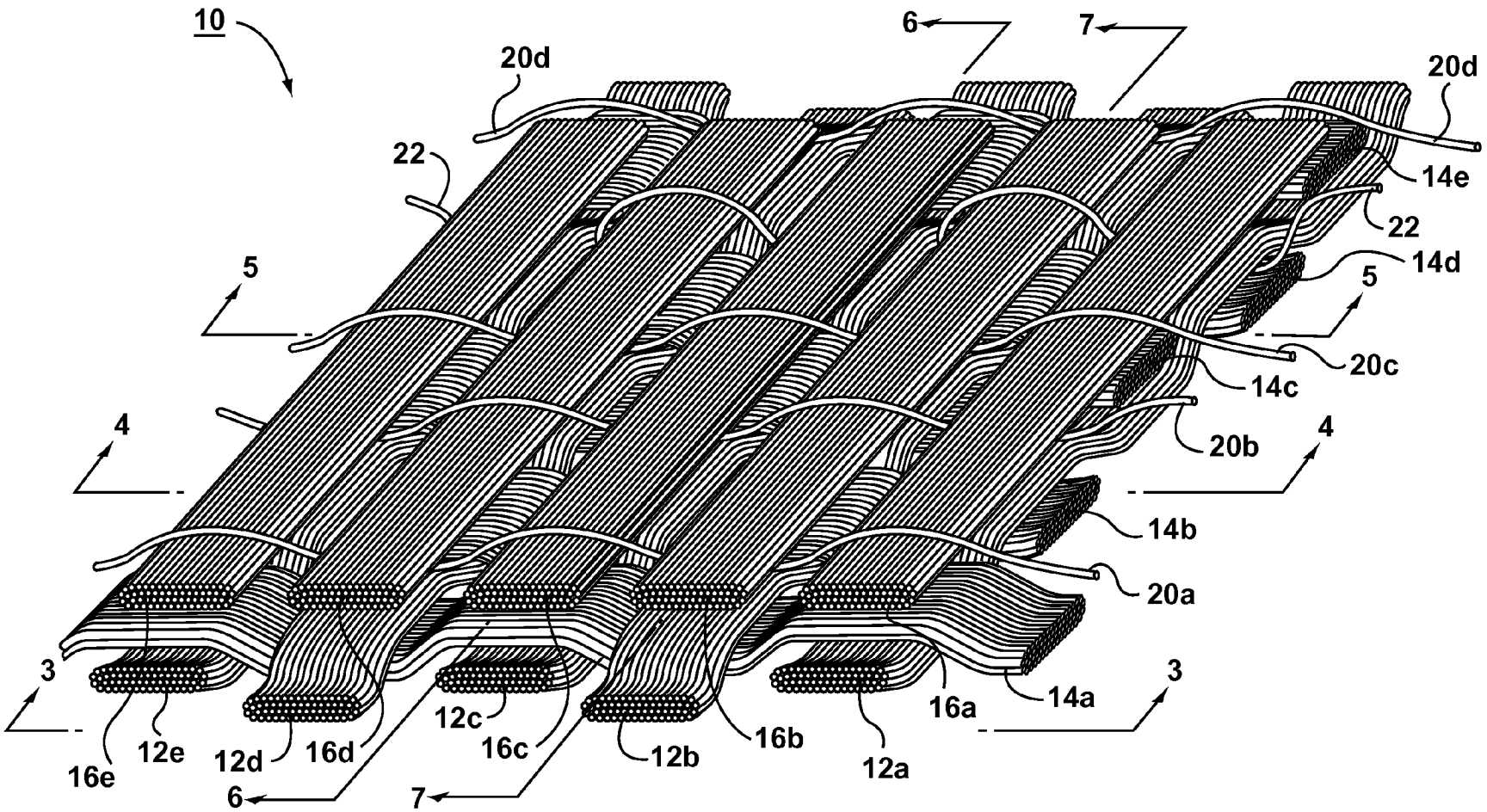
FIG. 1 is an overhead perspective view of a multi-layer fabric according to one embodiment.
Figure 2:
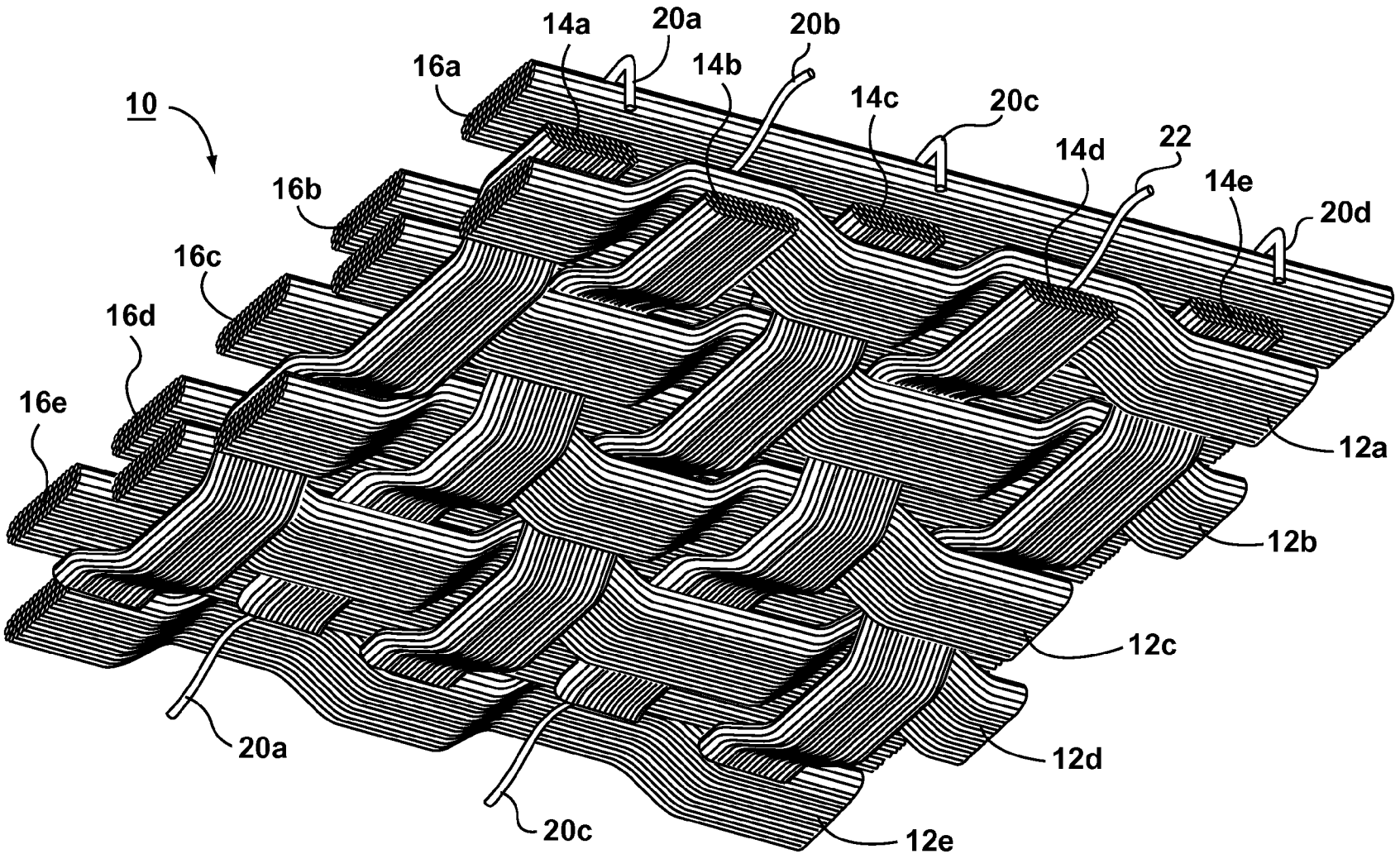
FIG. 2 is a lower perspective view of the fabric of FIG. 1.

For example, as shown in FIGS. 1 and 2, a first warp yarn 12*a* passes (e.g. is woven) underneath a first weft yarn 14*a*, over a second weft yarn 14*b*, underneath a third weft yarn 14*c*, over a fourth weft yarn 14*d* and underneath a fifth weft yarn 14*e*.

Adjacent warp and weft yarns may alternate as shown, so that, for example a second warp yarn 12*b* may pass over the first, third and fifth weft yarns 14*a*, 14*c*, 14*e*, and pass underneath the second and fourth weft yarns 14*b*, 14*d*.

In some embodiments, the warp yarns 12 are aligned with the longitudinal direction of the fabric 10, and the weft yarns 14 are oriented perpendicularly to the warp yarns 12. In other embodiments, the warp yarns 12 may be aligned with the longitudinal direction of the fabric 10.

Each of the warp yarns 12 and weft yarns 14 may include a plurality of fibers or filaments of one or more materials as will be described in greater detail below.

The fabric 10 also includes a unidirectional or non-crimped portion that includes at least one layer of unidirectional yarns. For example, as shown the unidirectional portion of the fabric 10 includes a layer of unidirectional yarns 16 having a first unidirectional yarn 16*a*, a second unidirectional yarn 16*b*, a third unidirectional yarn 16*c*, a fourth unidirectional yarn 16*d*, and a fifth unidirectional yarn 16*e*.

As shown, the unidirectional yarns 16 are generally parallel to each other in a layer with a common plane and do not have the crimp of the warp yarns 12 and weft yarns 14.

As shown, the unidirectional yarns 16 may be aligned with the warp yarns 12. In other embodiments, the unidirectional yarns 16 may be aligned with the weft yarns 14. In yet other embodiments, the unidirectional yarns may not be aligned with either the warp yarns 12 or the weft yarns 14.

As shown, the fabric 10 also includes encapsulating yarns 20 that secure the unidirectional yarns 16 together. As shown, the encapsulating yarns 20 may be generally perpendicular to the unidirectional yarns 16 and pass over and under the unidirectional yarns 16 in an interwoven pattern thus "encapsulating" the unidirectional yarns 16 therebetween. As shown, the encapsulating yarns 20 can be interwoven with the unidirectional yarns 16 without being interwoven with the first woven portion that includes warp yarns 12 and weft yarns 14.

Figure 3:
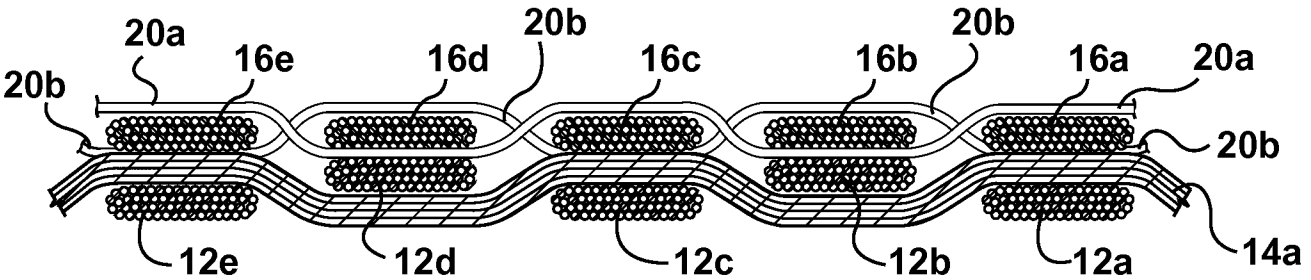
FIG. 3 is a cross sectional view of the fabric of FIG. 1 taken through line 3-3.

For example, as shown in FIGS. 1 and 3, the first encapsulating yarn 20*a* is woven over the first unidirectional yarn 16*a*, under the second unidirectional yarn 16*b*, over the third unidirectional yarn 16*c*, under the fourth unidirectional yarn 16*d*, and over the fifth unidirectional yarn 16*e*.

Figure 4:
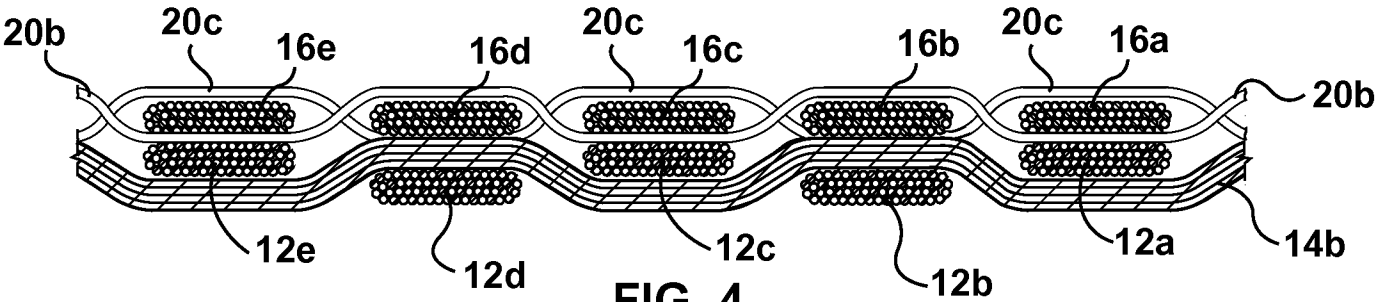
FIG. 4 is a cross sectional view of the fabric of FIG. 1 taken through line 4-4.

Adjacent encapsulating yarns may have an alternating or staggered weave. For example, as shown in FIGS. 1, 3 and 4, the second encapsulating yarn 20*b* may pass underneath the first, third and fifth unidirectional yarns 16*a*, 16*c*, 16*e*, while passing over the second and fourth unidirectional yarns 16*b*, 16*d*. In this manner, the unidirectional yarns 16 can be secured together to generally form a unidirectional layer within the unidirectional or non-crimped portion.

The fabric 10 also includes and at least one securing yarn 22 that generally secures the unidirectional portion (e.g. the unidirectional yarns 16) to the woven portion (e.g. the warp yarns 12 and weft yarns 14). As shown, the securing yarns 22 may be generally parallel to or aligned with the encapsulating yarns 20 and generally perpendicular to the unidirectional yarns 16.

Figure 5:
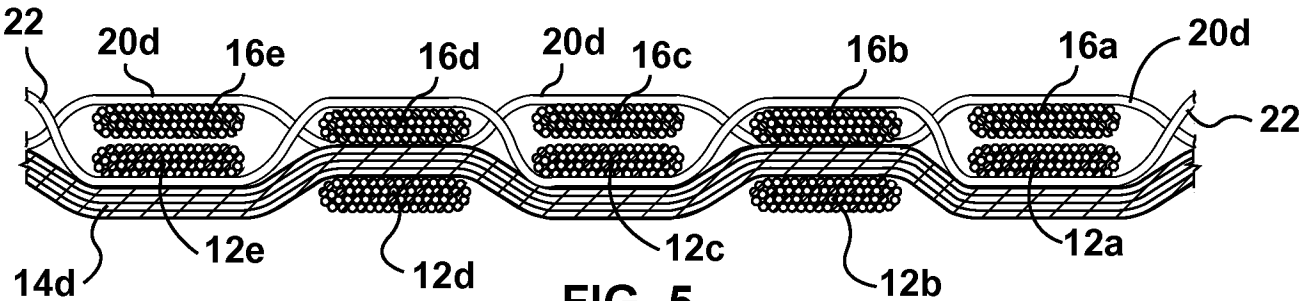
FIG. 5 is a cross sectional view of the fabric of FIG. 1 taken through line 5-5.
Figure 6:
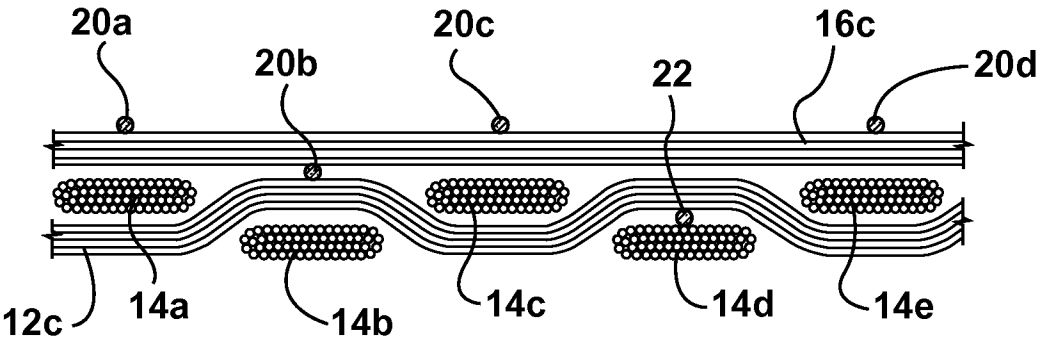
FIG. 6 is a cross sectional view of the fabric of FIG. 1 taken through line 6-6.
Figure 7:
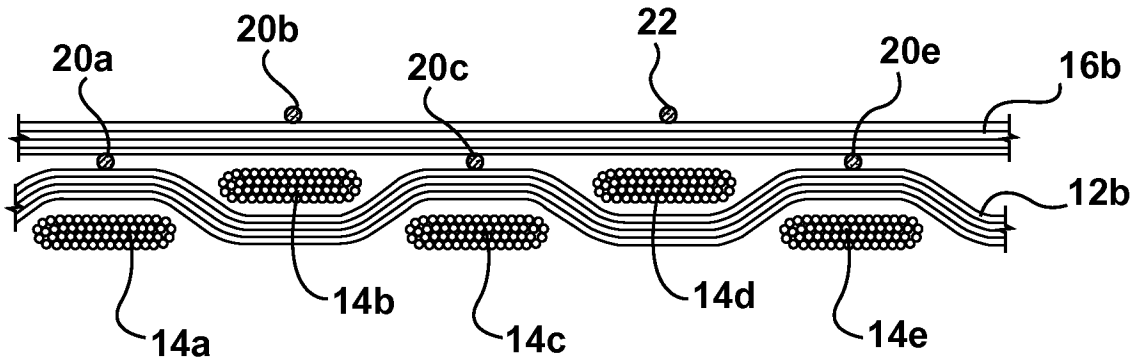
FIG. 7 is a cross sectional view of the fabric of FIG. 1 taken through line 7-7.

For example, as shown in FIGS. 1 and 5, the securing yarn 22 is woven underneath the first warp yarn 12*a*, over the second unidirectional yarn 16*b*, underneath the third warp yarn 12*c*, over the fourth unidirectional yarn 16*d*, and underneath the fifth warp yarn 12*e*. In this manner, the unidirectional or non-crimped portion (including the unidirectional yarns 16) and the woven or non-crimped portion (including the warp yarns 12 and weft yarns 14) may be secured together.

Since the securing yarns 22 generally form part of the woven fabric 10, there is no need for stitching or other mechanisms to join the unidirectional portion to the woven portion.

In this manner, a fabric having both woven and crimped portions and unidirectional or non-crimped portions can be provided as a unified construction, without the need for joining of two different fabric layers together (e.g. a woven layer and a unidirectional layer) subsequent to their formation.

In some embodiments, the securing yarns 22 can be woven with different weave pattern. For example, in some embodiments the securing yarns 22 may pass over two or more adjacent unidirectional yarns 16 and then pass under two or more warp yarns 12.

In some embodiments, the selection and arrangement of the encapsulating yarns 20 and securing yarns 22 may be varied to obtain desired performance of the fabric 10. For example, the ratio of encapsulating yarns 20 to securing yarns 22 may be different in different embodiments of the fabric 10. In the embodiment shown for example, three encapsulating yarns 20 are provided for each securing yarn 22. In other embodiments, one or more encapsulating yarns 20 could be provided for each securing yarn 22. For example, a single encapsulating yarn 20 could be provided for each securing yarn 22, or ten or more encapsulating yarns 20 could be provided for each securing yarn 22.

The ratio between encapsulating yarns 20 and securing yarns 22 tends to be dictated by the desired inter-layer stability (e.g. more securing tends to result in a more stable fabric 10) versus the degree of interference on the woven side (e.g. more securing tends to result in the woven portion deviating more from a conventional woven fabric).

In some embodiments, the fabric 10 may be provided with securing yarns 22 and without encapsulating yarns 20 (e.g. the encapsulating yarns 20 may all be replaced with securing yarns 22).

In some embodiments, each securing yarn 22 may be provided between two encapsulating yarns (e.g. the third encapsulating yarn 20*c* and the fourth encapsulating yarn 20*d*, as shown in FIG. 1) and may continue the alternating or staggered weaving pattern of the encapsulating yarns (as shown in FIG. 1). In other embodiments, the securing yarn 22 may have a weaving pattern that does not correspond to the weaving pattern of the encapsulating yarns 20. For example, two or more securing yarns 22 could be provided adjacent to each other.

In the fabric 10 as shown, the warp yarns 12 and weft yarns 14 are generally perpendicular with respect to each other, with the unidirectional yarns 16 aligned with the warp yarns 12, and the encapsulating yarns 20 and securing yarns 22 generally perpendicular to the unidirectional yarns 16. However, the warp yarns 12, weft yarns 14, unidirectional yarns 16, encapsulating yarns 20 and securing yarns 22 could be oriented at other angles including non-perpendicular angles. Furthermore, while the terms "warp yarn" and "weft yarn" are used herein, these terms are specifically not meant to be limiting, and in particular the fabric 10 could be used with unidirectional yarns 16 aligned with either the warp yarn 12 (as shown) or alternatively with the weft yarn 14.

In some embodiments, the unidirectional yarns 16 in the fabric 10 generally are not substantially constrained by the encapsulating yarns 20 and the securing yarns 22 since the encapsulating yarns 20 and securing yarns 22 are typically made from a low strength, low modulus yarn, as described in greater detail below.

According to some embodiments, the fabric 10 may be woven on standard weaving looms, including rapier, shuttle, air jet and water jet looms.

In some embodiments, the warp yarns 12, weft yarns 14 and unidirectional yarns 16 may be yarns having a tenacity of about 15 grams per denier and higher, and with a tensile modulus of at least about 400 grams per denier. Some examples of suitable yarns could include carbon, basalt and glass fibers. Other examples include aramid and copolymer aramid fibers (produced commercially by DuPont and Teijin under the trade names Kevlar®, Twaron®, and Technora®), extended chain polyethylene fibers (produced commercially by Honeywell, and DSM, under the trade names Spectra®, and Dyneema®), polyethylene fibers and films produced by Synthetic Industries and sold under the trade name Tensylon®, poly(p-phenylene-2,6-benzobisoxa-zole) (PBO) (produced by Toyobo under the commercial name Zylon®), and Liquid crystal polymers produced by Kuraray under the trade name Vectran®. Other suitable yarns may also be used.

In some embodiments, the encapsulating yarns 20 and the securing yarns 22 are generally of significantly smaller denier than the warp yarns 12, weft yarns 14 and/or the unidirectional yarns 16 and have significantly lower tenacities and tensile moduli. As a result, the encapsulating yarns 20 and securing yarns 22 tend to greatly reduce or eliminate undesirable crimping in the unidirectional yarns 16.

In some examples, the encapsulating yarns 20 and securing yarns 22 have a tenacity of less than about 10 grams per denier, and a tensile modulus of less than about 40 grams per denier. In one specific example, the encapsulating yarns 20 and securing yarns 22 may be made of polyester having a tenacity of about 7.9 grams per denier, and a tensile modulus of about 39.5 grams per denier. In other examples, a vast range of suitable yarns can be used for the encapsulating yarns 20 and securing yarns 22.

In some examples, the denier of the encapsulating yarns 20 and the securing yarns 22 may range from between about 20 denier (or less), to about 1000 denier, depending on the size of the warp yarns 12, weft yarns 14, and unidirectional yarns 16, and the desired structural application.

The encapsulating yarns 20 and the securing yarns 22 are generally of a much smaller size than the warp yarns 12, weft yarns 14 and unidirectional yarns 16. The diameter of the encapsulating yarns 20 and the securing yarns 22 may be selected based on the moduli and strength parameters of the encapsulating yarns 20 and the securing yarns 22. In some examples, the encapsulating yarns 20 and the securing yarns 22 may have a diameter that is between about 2.5% and about 14% of the diameter of the warp yarns 12, weft yarns 14 and unidirectional yarns 16.

In some examples, the encapsulating yarns 20 and the securing yarns 22 may be selected from a wide range of fibers. Some suitable example fibers include natural fibers, such as cotton, wool, sisal, linen, jute and silk. Other suitable fibers include manmade or synthetic fibers and filaments, such as regenerated cellulose, rayon, polynosic rayon and cellulose esters, synthetic fibers and filaments, such as acrylics, polyacrylonitrile, modacrylics such as acrylonitrile-vinyl chloride copolymers, polyamides, for example, polyhexamethylene adipamide (nylon 66), polycaproamide (nylon 6), polyundecanoamide (nylon 11), polyolefin, for example, polyethylene and polypropylene, polyester, for example, polyethylene terephthalate, rubber and synthetic rubber and saran. Glass, carbon or any other high performance fiber may also be used.

Staple yarns may also be used and may include any of the above fibers, low denier staple yarns or any combination of these yarns. Staple yarns may be used particularly where the base properties of continuous filament yarns exceed the maximum allowable properties required in a quasi-unidirectional fabric. Staple yarns, by the discontinuous nature of their filaments that form the yarn, tend to have much lower tensile and modulus properties as opposed to yarns composed of continuous filaments.

The performance of the fabric 10 is generally a function of the properties of the encapsulating yarns 20 and the securing yarns 22 and the warp yarns 12, weft yarns 14 and unidirectional yarns 16. In composite structures, maximizing the amount of the structural fibres (e.g. the warp yarns 12, the weft yarns 14 and the unidirectional yarns 16) in a given volume tends to be beneficial, as higher fibre volume fraction generally signifies higher structural properties. Therefore, in some examples it may be desirable that the encapsulating yarns 20 and the securing yarns 22 have a denier that is as low as practical to weave the fabric 10.

In the fabric 10, it may be desirable to minimize the weight of the encapsulating yarns 20 and the securing yarns 22 as a percentage of the total weight of the fabric 10, since the encapsulating yarns 20 and the securing yarns 22 may not contribute as much to the structural strength of the fabric 10 as the structural yarns (e.g. the warp yarns 12, the weft yarns 14, and the unidirectional yarns 16). Conversely, an increased quantity of encapsulating yarns 20 and securing yarns 22 may result in a more durable, stable fabric 10, however, the fabric 10 will tend to be heavier and may have reduced structural properties due to the increased constraints on the structural yarns 12, 14, 16.

In some examples, the lowest denier, lowest strength encapsulating yarns 20 and securing yarns 22 that can be woven and which satisfy the requirements for a particular application may be provided.

The fabric 10 described herein may be further processed to form a structural member or panel. For example, the fabric 10 may be fabricated into a prepreg using a film or a wet resin. Depending on the application, the film or resin may be applied to one side of the fabric 10, the fabric 10 may be totally impregnated with a resin, or the film may be worked into the fabric 10. In some examples, the film or resin may be a thermoplastic or a thermoset resin. Generally, any resin or film that can be used to create a prepreg may be used with this fabric 10. In some embodiments, two or more layers of fabric 10 may also be laminated together to further increase the number of layers. In particular, epoxy resin is widely used for many structural applications and may be used with the fabric 10.

In some embodiments, the fabric 10 may also include a second woven portion (not shown) provided opposite the first woven portion (e.g. on the other side of the unidirectional portion) so that the unidirectional portion is provided between the first woven portion and the second woven portion.

Figure 8:
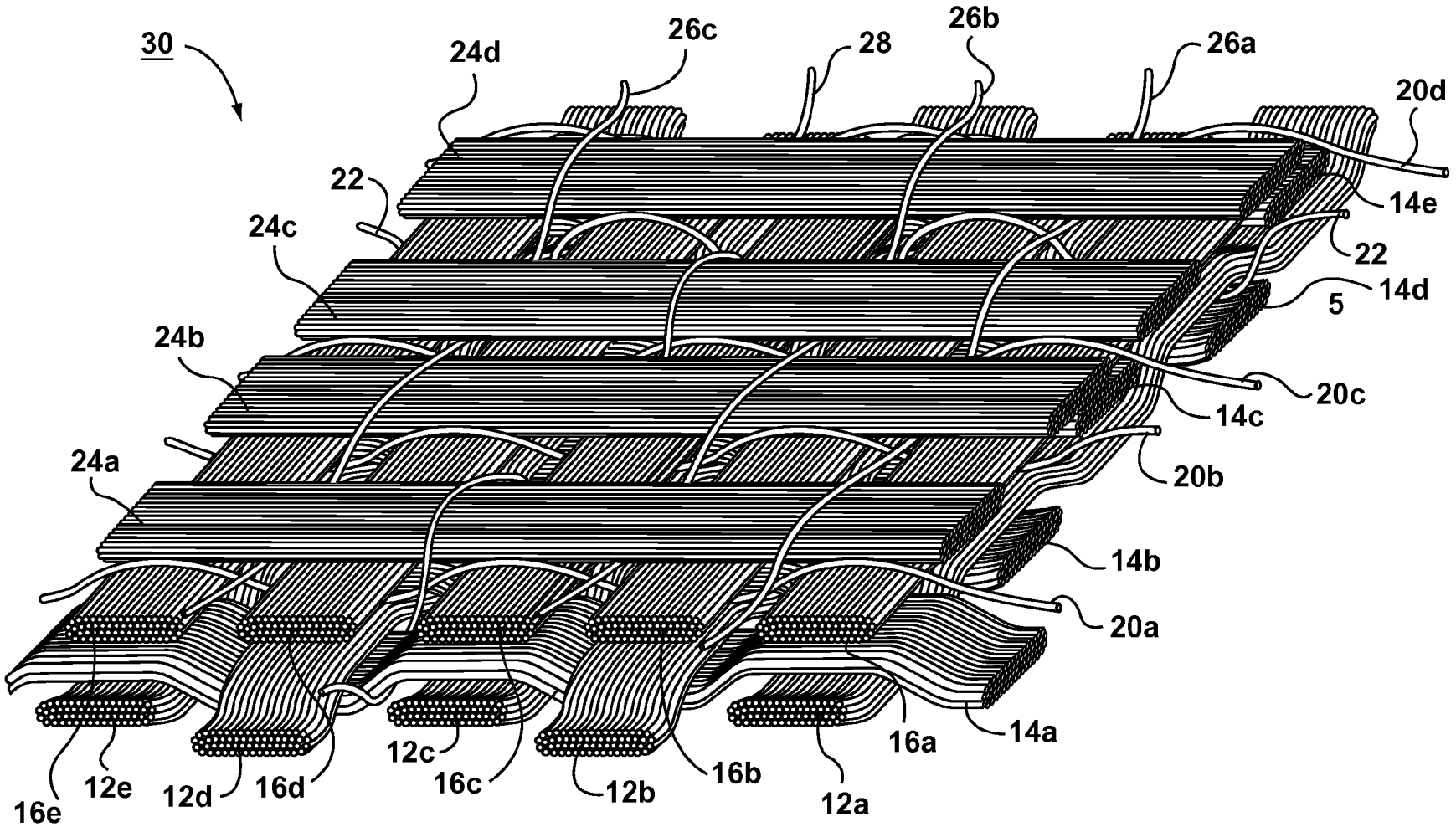
FIG. 8 is an overhead perspective view of a multi-layer fabric according to another embodiment having a second unidirectional layer.

Turning now to FIGS. 8, illustrated therein is a fabric 30 according to another embodiment of the invention. In this example, the fabric 30 has yarn pattern similar to fabric 10 described above, and includes warp yarns 12, weft yarns 14, unidirectional yarns 16, first encapsulating yarns 20 and first securing yarns 22 generally as described above. However, the unidirectional portion of the fabric 30 also includes a second layer of unidirectional yarns 24.

As shown, the second layer of unidirectional yarns 24 may be oriented at a first angle (e.g. 90 degrees) with respect to the first layer of unidirectional yarns 16. Particularly, when unidirectional yarns 16, 24 are used in the reinforcement of composites, it may be desirable to have the layers of unidirectional yarns 16, 24 oriented transversely (at 90 degrees) to each other.

In other embodiments, the unidirectional yarns 24 may be generally oriented at any suitable angles, (e.g. +/−45 degrees to the unidirectional yarns 16, and so on).

As shown, the second layer of unidirectional yarns 24 may be held together by second encapsulating yarns 26. For example, a second encapsulating yarn 26*a* may pass over a first unidirectional yarn 24*a*, underneath a second unidirectional yarn 24*b*, over a third unidirectional yarn 24*c*, and underneath a fourth unidirectional yarn 24*d*.

Adjacent encapsulating yarns 26 may have an alternating or staggered weave pattern. For example, as shown in FIG. 8 a second encapsulating yarn 26*b* may pass underneath the first and third unidirectional yarns 24*a*, 24*c* and over the second and fourth unidirectional yarns 24*b*, 24*d*.

The second layer of unidirectional yarns 24 may be secured to the first layer of unidirectional yarns 16 and/or the woven portion (e.g. the warp yarns 12 and weft yarns 14) generally similar to as above via second securing yarns 28. For example, as shown, the second securing yarn 28 may pass underneath the first weft yarn 14*a*, over the first unidirectional yarn 24*a*, underneath the third weft yarn 14*c*, over the third unidirectional yarn 24*c* and underneath the fifth weft yarn 14*e*.

In some embodiments, the second securing yarn 28 may not pass underneath the weft yarns 14 but may simply pass underneath the first encapsulating yarns 20 and/or the first securing yarns 22 in the first layer of unidirectional yarns 16. In this manner, the second securing yarns 28 engage the first encapsulating yarns 20 and/or the first securing yarns 22, thus securing the first and second layers of unidirectional yarns 16, 24 together.

In some embodiments, the unidirectional portion may include one or more layers of quasi-unidirectional fabric as generally described in U.S. Provisional Patent Application Ser. No. 61/030,587, the entire contents of which are hereby incorporated by reference. The one or more layers of quasi-unidirectional fabric may be secured to the woven portion using securing yarns generally similar to as described above.

Figure 9:
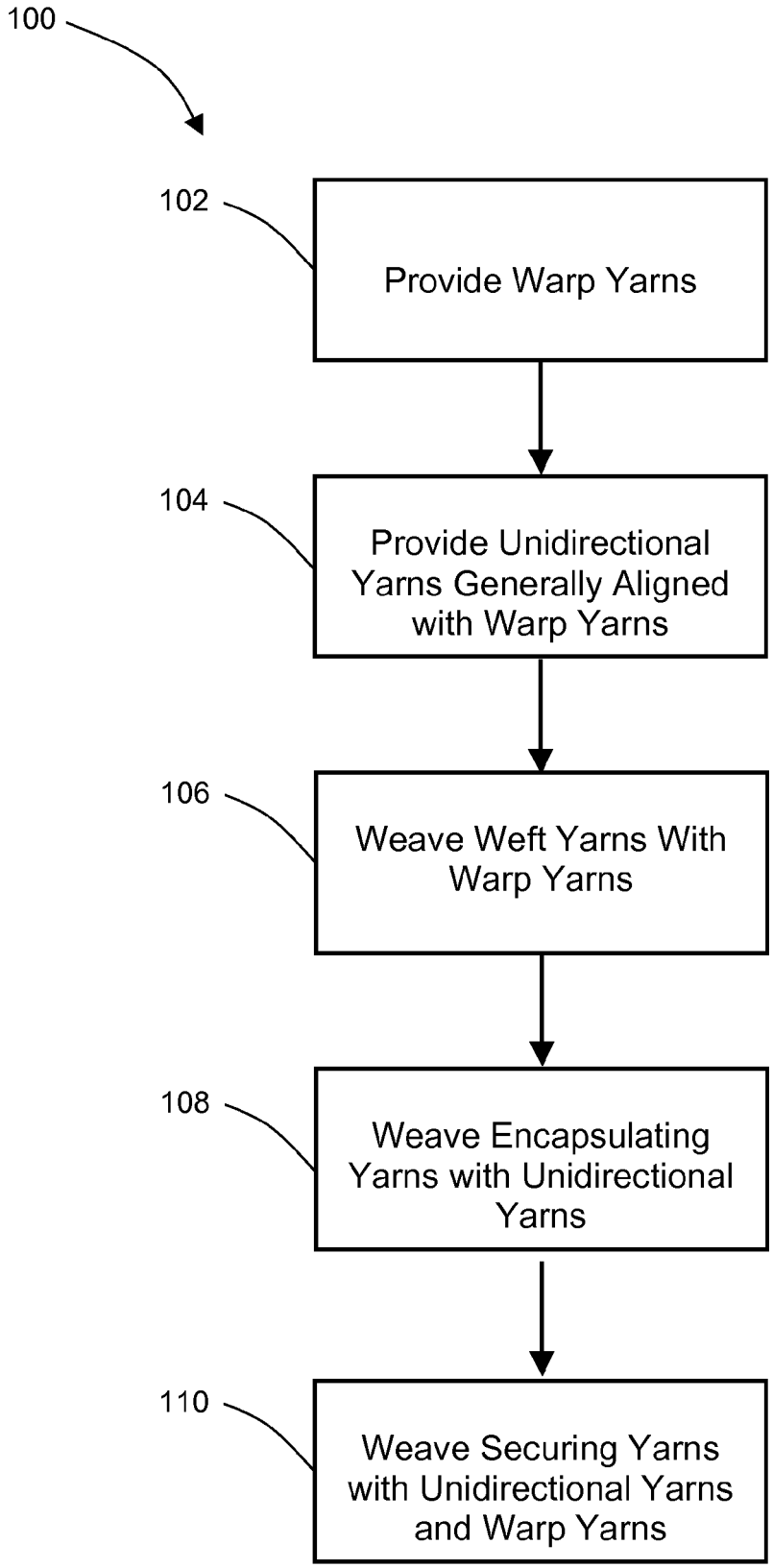
FIG. 9 is a flowchart illustrating a method of manufacturing a multi-layer fabric according to another embodiment.

Turning now to FIG. 9, illustrated therein is a method 100 of forming a woven unidirectional fabric according to one embodiment.

At step 102, warp yarns are provided. For example, warp yarns 12 may be provided on a loom or weaving machine.

At step 104, unidirectional yarns are provided generally in alignment with the warp yarns. For example, the unidirectional yarns 16 may be provided on a loom or weaving machine generally adjacent the warp yarns 12.

At step 106, weft yarns are interwoven with the warp yarns. For example, the weft yarns 14 could be interwoven with the warp yarns 12 by alternatively moving the warp yarns 12 up and down and passing a shuttle with the weft yarns 14 therebetween, as will generally be understood.

At step 108, the encapsulating yarns are interwoven with the unidirectional yarns. For example, the encapsulating yarns 20 may be interwoven with the unidirectional yarns 16 by alternatively moving the unidirectional yarns 16 up and down and passing a shuttle with the encapsulating yarns 20 therebetween, as will be generally understood.

At step 110, the securing yarns are interwoven with the unidirectional yarns and the warp yarns to secure the unidirectional yarns to the warp yarns. For example, the securing yarns 22 may be interwoven with the unidirectional yarns 16 and the warp yarns 12 by selectively moving the unidirectional yarns 16 and the warp yarns 12 up and down and passing a shuttle with the securing yarns 22 therethrough. In some embodiments, steps 108 and 110 may be performed using the same shuttle such that the encapsulating yarns 20 and securing yarns 22 are formed of a continuous piece of yarn.

In some embodiments, a particular securing yarn may be interwoven with the warp yarns prior to the adjacent weft yarn being woven thereto. For example, with reference to FIG. 5 in particular, the securing yarn 22 may be interwoven with the first, third and fifth warp yarns 12*a*, 12*c*, 12*e* and the second and fourth unidirectional yarns 16*b*, 16*d*, prior to the fourth weft yarn 14*d* being interwoven between the warp yarns 12*a*, 12*b*, 12*c*, 12*d*, and 12*e*.

It will be appreciated that the steps 102-110 of the method 110 generally do not have to be done in a specific order and that the order as listed is in no way meant to be limiting. In particular, steps 108-110 could be done before steps 104-106 in some embodiments, or the order of steps 110 and 108 could be reversed.

The fabrics described herein can be designed for use in various structural applications, such as in rigid panels for use in the aerospace industry. The fabrics may be used by themselves or in combination with various other fabrics and materials to produce structural elements. Such other fabrics may include woven fabrics made of aramids, polyethylene, poly (p-phenylene-2,6-benzobisoxazole) (PBO) fibers, carbon fibres, and basalt or glass fibers. The other fabrics may also include various unidirectional products based on known unidirectional technology where the structural fibers are aramids, polyethylene or poly(p-phenylene-2,6-benzobisoxazole) (PBO).

The fabrics described herein may generally be used in any combination with the materials listed above and may replace any one material or combination of materials in an existing structural fabric. In addition, the fabrics described herein may be laminated together or laminated with films to produce structural elements for various applications, including rigid and resilient applications. The proportions of each material selected and the design of the structural elements may vary depending on the intended application (i.e., particular specifications for aerospace applications).

In some example fabrics, the ratio of the diameter of the encapsulating yarns 20 and securing yarns 22 to the diameter of the structural yarns (e.g. the warp yarns 12, weft yarns 14 and unidirectional yarns 16) should be as low as possible (with all other factors being equal) to allow for tight packing of the structural yarns.

While the above description provides examples of one or more fabrics, processes or apparatuses, it will be appreciated that other fabrics, processes or apparatuses may be within the scope of the present description as interpreted by one of skill in the art.

The invention claimed is:

1. A rigid panel for structural applications, comprising:

a. at least one multi-layer fabric, each multi-layer fabric comprising:

i. a first woven portion having structural warp yarns and structural weft yarns interwoven together to form a first woven layer, the structural warp yarns and weft yarns being made of aramid fibers;

ii. a unidirectional portion that includes a first unidirectional layer having first structural unidirectional yarns, the first unidirectional layer being adjacent the first woven layer, and the first structural unidirectional yarns being made of aramid fibers;

iii. at least one securing yarn interwoven with the first woven layer and the first unidirectional layer to secure the first unidirectional portion to the first woven portion, the at least one securing yarn being made of a polyester; and iv. encapsulating yarns interwoven with the first unidirectional yarns first woven portion to secure the first unidirectional yarns together to form the first unidirectional layer, the encapsulating yarns being made of a polyester;

v. wherein the encapsulating yarns and the securing yarns have a diameter that is less than about 14% of the diameter of the warp yarns, weft yarns and unidirectional yarns; and b. a thermoset epoxy resin applied to the at least one multi-layer fabric, the epoxy resin selected to secure the at least one multi-layer fabric together to form the rigid panel.

2. The rigid panel of claim 1, wherein the unidirectional yarns are aligned with the warp yarns, and at least one of the securing yarns is woven underneath a first warp yarn, over a second unidirectional yarn, underneath a third warp yarn, over a fourth unidirectional yarn, and underneath a fifth warp yarn.

3. The rigid panel of claim 1, wherein the encapsulating yarns and securing yarns are made from a low strength, low modulus polyester yarn.

4. The rigid panel of claim 1, wherein the warp yarns, weft yarns and unidirectional yarns have a tenacity of at least about 15 grams per denier, and a tensile modulus of at least about 400 grams per denier.

5. The rigid panel of claim 1, wherein the encapsulating yarns and the securing yarns are of smaller denier than the warp yarns, weft yarns and the unidirectional yarns and have lower tenacities and tensile moduli to reduce or eliminate crimping in the unidirectional yarns.

6. The rigid panel of claim 1, wherein the encapsulating yarns and securing yarns have a tenacity of less than about 10 grams per denier, and a tensile modulus of less than about 40 grams per denier.

7. The rigid panel of claim 1, wherein the denier of the encapsulating yarns and the securing yarns is less than about 1000 denier.

8. The rigid panel of claim 1, wherein the encapsulating yarns and the securing yarns have a diameter that is between about 2.5% and about 14% of the diameter of the warp yarns, weft yarns and unidirectional yarns.

9. The rigid panel of claim 1, wherein the unidirectional portion includes a second unidirectional layer having second unidirectional yarns, the second unidirectional yarns oriented at a first angle with respect to the first layer of unidirectional yarns.

10. The rigid panel of claim 9, wherein the second layer of unidirectional yarns is secured to at least one of the first layer of unidirectional yarns and the first woven layer using at least one second securing yarn.

11. The rigid panel of claim 9, wherein the second unidirectional yarns are secured together by second encapsulating yarns interwoven therebetween so as to form the second unidirectional layer.

12. The rigid panel of claim 10, wherein the second securing yarns are interwoven with the first encapsulating yarns to secure the second unidirectional layer to the first unidirectional layer.

13. The rigid panel of claim 1, further comprising a second woven portion opposite the first woven portion on the other side of the first unidirectional portion.

14. The rigid panel of claim 1, wherein at least three encapsulating yarns are provided for each securing yarn.

15. The rigid panel of claim 1, wherein adjacent encapsulating yarns have an alternating weave.

16. The rigid panel of claim 15, wherein each securing yarn is provided between two encapsulating yarns and continues the alternating weave.

* * * * *